US010835065B2

(12) United States Patent
Löhn et al.

(10) Patent No.: US 10,835,065 B2
(45) Date of Patent: Nov. 17, 2020

(54) DRINKING VESSEL HAVING A DRINKING VALVE

(71) Applicant: MAPA GMBH, Zeven (DE)

(72) Inventors: Jürgen Löhn, Zeven (DE); Ralf Holschumacher, Zeven (DE); Eckhard Itzek, Zeven (DE)

(73) Assignee: MAPA GMBH, Zeven (DE)

( * ) Notice: Subject to any disclaimer, the term of this patent is extended or adjusted under 35 U.S.C. 154(b) by 308 days.

(21) Appl. No.: 15/537,993

(22) PCT Filed: Dec. 23, 2015

(86) PCT No.: PCT/EP2015/081215
§ 371 (c)(1),
(2) Date: Jun. 20, 2017

(87) PCT Pub. No.: WO2016/102698
PCT Pub. Date: Jun. 30, 2016

(65) Prior Publication Data

US 2017/0354279 A1 Dec. 14, 2017

(30) Foreign Application Priority Data

Dec. 23, 2014 (DE) ..... 20 2014 106 275 U

(51) Int. Cl.
*A47G 19/22* (2006.01)
*A47G 21/18* (2006.01)
(Continued)

(52) U.S. Cl.
CPC ..... *A47G 19/2272* (2013.01); *A47G 19/2222* (2013.01); *A47G 21/18* (2013.01);
(Continued)

(58) Field of Classification Search
CPC ..... A47G 19/2272; A47G 21/18; A47G 19/2266; A47G 19/22; A47G 21/185; A61M 39/22; B65D 47/2081
(Continued)

(56) References Cited

U.S. PATENT DOCUMENTS 7,819,276 B2 * 10/2010 Naesje ..... A47G 19/2272 220/714

FOREIGN PATENT DOCUMENTS

WO WO 03/068036 8/2003
WO WO-03068036 A1 * 8/2003 ..... A47G 19/2272

OTHER PUBLICATIONS

International Search Report issued by European Patent Office dated Apr. 12, 2016.

* cited by examiner

*Primary Examiner* — Anthony D Stashick
*Assistant Examiner* — Lauren Kmet
(74) *Attorney, Agent, or Firm* — Eversheds Sutherland (US) LLP

(57) ABSTRACT

The present disclosure is directed to a drinking vessel that can include a drinking container and a drinking attachment that is coupled to the container. A straw can be positioned through an opening in the drinking attachment. The straw can include a top end that includes an opening through which a user can withdraw liquid and a bottom end. A drinking valve can be positioned along the bottom end of the straw and can include a tube that is open on the top and closed on the bottom and further includes at least one flow-through opening connecting the inside of the valve to the outside of the straw. A suction tube can include a tube wall that can be slid over the valve to couple the straw to the suction tube.

18 Claims, 20 Drawing Sheets

(51) Int. Cl.
*B65D 47/06* (2006.01)
*B65D 47/24* (2006.01)

(52) U.S. Cl.
CPC ..... *A47G 21/185* (2013.01); *B65D 47/06* (2013.01); *B65D 47/248* (2013.01); *A47G 2400/027* (2013.01); *B65D 2205/02* (2013.01); *B65D 2543/00046* (2013.01)

(58) Field of Classification Search
USPC ..... 220/714
See application file for complete search history.

29

25
4
19
3
40
22
38
32
33
27
41
28
1
44
26
2
7

DRINKING VESSEL HAVING A DRINKING VALVE

CROSS-REFERENCE TO RELATED APPLICATIONS

This application is the National Stage of International Application No. PCT/EP2015/081215, filed Dec. 23, 2015, which claims priority to German patent Application No. 202014106275.0, filed Dec. 23, 2014, which is hereby incorporated by reference.

The invention relates to a drinking vessel comprising a drinking container and a drinking attachment having a drinking valve. The drinking container can in particular be designed as drinking bottle (nutrition baby bottle, drinking cup or nutrition bag) and the drinking attachment as drinking aid (e.g. nutrition spout or drinking spout) or as drinking straw according to European standard EN14350-1.

Drinking containers have an interior and a container opening, through which access to the interior is possible. Drinking attachments have a bottom wall, an annular flange circulating around the bottom wall, for fastening to the rim of the container opening so as to form a seal by means of a fastening ring and a drinking element, which protrudes from the bottom wall on the outside. The fastening ring is connected to the annular flange in one piece or is a separate component, which engages over the annular flange of the drinking attachment, in order to hold it on the rim of the container opening. On the outer end, the drinking element has a drinking opening, which is connected to the inside of the mouthpiece via a passage channel, so that liquid can flow out of the interior through the passage channel.

A drinking valve, which opens when applying an underpressure to the drinking opening, is integrated into the drinking element. The bottom wall further has a venting valve, which opens when an underpressure is built up in the drinking container. The valves are to prevent the drinking container from spilling and are to make it possible to remove liquid and a pressure compensation with the environment. In many cases, the valves are slit valves comprising basic bodies of silicon, which are produced by means of injection molding, into which slits are integrated subsequently by means of knives or by tearing by means of special devices.

The drinking element is preferably a mouthpiece or a drinking straw. Preferably, mouthpiece, bottom wall, annular flange and, if applicable, fastening ring, are formed in one piece of one or a plurality of plastics.

Known drinking containers comprising drinking straw have a tubular holder in the bottom wall, into which the drinking straw is inserted so as to form a seal. An upper section of the drinking straw protrudes beyond the upper side of the bottom wall and a lower section protrudes from the underside of the bottom wall into the drinking vessel. The lower section and a suction tube, which protrudes downwards, into the vicinity of the container bottom, are plugged together. The drinking straw can be sealed for example by bending over and fixing the bent drinking straw by means of a cover, which is clamped onto the drinking attachment. The sealing by bending over the drinking straw is unreliable and susceptible to wear. Drinking straws comprising slit valves have a separating wall, which blocks the passage channel and into which slits are incorporated by means of knives or by tearing. Drinking straws comprising non-return valve are further known.

The production of the slit valves is extensive. The rims of the slits further abut one another by means of only a slight pressure and there is a risk that they are not spill-proof and open even in the case of small pressure differences.

Due to the poor accessibility, the cleaning of the known drinking valves is difficult. Remaining contaminations can bond the drinking valves, make it difficult to open them and can lead to contaminations of the beverage.

Based on this, it is the object of the invention to provide a drinking vessel, which has more favorable production characteristics, which seals and opens safely and which can be cleaned more easily.

The object is solved by a drinking vessel having the features of claim 1. Advantageous embodiments of the drinking vessel are specified in the subclaims.

The drinking vessel according to the invention comprises

- a drinking container comprising an interior,
- a drinking attachment comprising a bottom wall and an elongated drinking element, which protrudes upwards from the bottom wall and which has at least one drinking opening on the outer end, which is connected to the interior via a passage channel, which extends through the drinking element,
- holding devices for releasably holding the drinking attachment on the drinking container,
- a drinking valve arranged in the passage channel, which closes when ambient pressure is present at the drinking opening, and which opens when a suction underpressure is present at the drinking opening, characterized in that
- the drinking valve comprises a tube, which is open on the top and closed on the bottom, which, in a wall, has at least one flow-through opening, which connects the inside of the tube to the outside of the tube, wherein the wall of the tube, at least in the area of the flow-through opening, is formed as a soft elastic diaphragm, and
- when ambient pressure is present at the drinking opening, the tube abuts with the outer rim of the flow-through opening on the wall of the passage channel so as to form a seal and, when a suction underpressure is present at the drinking opening, the diaphragm bulges inwards, so that the outer rim of the flow-through opening moves away from the wall of the passage channel.

In the case of the drinking container according to the invention, the outer rim of the flow-through opening abuts the wall of the passage channel so as to form a seal, when ambient pressure is present at the drinking opening. The drinking valve hereby blocks the passage channel and prevents liquid to flow out of the interior. When a suction underpressure is present on the drinking opening, the soft elastic diaphragm bulges slightly inwards, so that the outer rim of the flow-through opening lifts off the wall of the passage channel. As a result, liquid can flow from the interior through the passage channel, the drinking valve and the drinking opening. When suction is no longer applied to the drinking opening, the diaphragm returns into its initial position, in which the outer rim of the flow-through opening abuts the wall of the passage channel so as to form a seal, and the drinking valve prevents liquid from flowing out. It is advantageous that the tube can be produced by injection molding in only one operating step and that the drinking valve can be assembled by simply inserting the tube into the passage channel. The drinking valve can further be disassembled easily and can be cleaned easily in the disassembled state, so that beverage residues do not remain on the drinking valve. As a result, the drinking valve opens and closes reliably and contaminations of the beverage are avoided. The extensive separate creation of the slits of common slit valves, the extensive assembly of common non-return valves and the difficult and often unsatisfactory cleaning of common drinking valves can be forgone.

The outer rim of the passage opening preferably abuts the wall of the passage channel under prestress. For this purpose, the tube preferably has an oversize with respect to the passage channel.

According to a design, the flow-through openings extends across the side wall of the tube. In the case of this design, the outer rim of the through-flow opening abuts a wall of the passage channel surrounding the tube. In the alternative, the through-flow openings extends across a front wall of the tube, which closes the tube on the lower end. In the case of this design, the outer rim of the flow-through opening abuts a bottom of the passage channel, which has an outlet opening to the interior, laterally offset to the outer rim of the passage opening.

According to a further design, the tube has a depression in the wall and the diaphragm is the bottom of the depression. A stable or stiff tube, respectively, can be realized through this, which can be slightly deformed in the area of the soft elastic diaphragm. Due to its stability, the tube can be assembled and disassembled better and is better protected against damages than a soft elastic tube as a whole. The depression is preferably located in the outer side of the wall of the tube. The embodiment of the diaphragm through a depression in the outside of the wall has advantages from a manufacturing aspect. On principle, the diaphragm can also be created by a depression on the inside of the wall of the tube. According to a preferred design, the depression is arranged in the side wall of the tube. The depression preferably has the geometric shape of a segment of a cylinder shell.

According to another design, the tube as a whole is formed as soft elastic diaphragm.

For example, the diaphragm has a wall thickness in the range of between 0.05 and 0.6 mm, preferably of between 0.2 and 0.4 mm, preferably of 0.3 mm.

According to a further design, a sealing bead or another sealing element, which circulates around the flow-through opening and which abuts the wall of the passage channel so as to form a seal, when ambient pressure is present at the drinking opening, protrudes to the outside from the outside of the diaphragm. Due to the sealing element, which protrudes to the outside, the outer rim of the flow-through opening abuts the wall of the passage channel with high pressure and an improved sealing effect is attained. The sealing element can further be formed in such a way that it protrudes beyond the depression from the outside of the tube, in order to abut a cylindrical wall of the passage channel. In the alternative, the passage channel can be provided with a sealing element, which protrudes inwards from its wall and which abuts the outer rim of the flow-through opening, when normal pressure is present at the drinking opening.

According to a further design, a base protrudes to the outside from the outside of the diaphragm, through which the flow-through opening extends, wherein the base abuts the wall of the passage channel so as to form a seal with the outer rim of the flow-through opening, when ambient pressure is present at the drinking opening, and lifts off the wall of the passage channel, when a suction underpressure is present at the drinking opening. Due to the base, an even abutment of the outer rim of the passage opening on the wall of the passage channel is favored.

According to a further design, the sealing element additionally protrudes outwards from the outside of the base.

According to a further design, the base is a massive, elongated element oriented in longitudinal direction of the tube, comprising a rectangular cross section. This design favors the abutment of the outer rim of the flow-through opening on the wall of the passage channel so as to form a seal.

According to a further design, the tube has at least one continued flow channel on the outside, which extends from the diaphragm to the lower end of the tube. The continued flow channel favors the continued flow of liquid form the interior to the flow-through opening, when applying suction to the drinking opening.

On principle, the tube can have a plurality of flow-through openings, which are for example arranged at different positions on the circumference of the tube. For reasons of stability of the tube, it can be advantageous that said tube only has one through-flow opening on only one side, so that the diaphragm only extends across a portion of the circumference of the tube.

According to a further design, the tube is made of a soft elastic material in one piece. Preferably, the material of the tube is polyurethane, silicon or a thermoplastic elastomer. The tube is preferably produced by means of injection molding. In the alternative, the tube consists of a combination of soft elastic and hard elastic materials, for example. The tube can for example be produced in two-component injection molding, in which it is injection molded of a soft elastic plastic in the area of the diaphragm and of a hard elastic plastic for the rest.

According to a further design, the drinking element is a drinking straw, which is connected to the tube on the lower end, and the tube is clamped into a suction tube, which protrudes into the drinking container from the underside of the bottom wall, wherein the outer rim of the flow-through opening abuts the wall of the suction tube so as to form a seal, when ambient pressure is present at the drinking opening, and lifts off the wall of the suction tube, when suction underpressure is present at the drinking opening. In the case of this design, the drinking valve is formed in a drinking straw. The drinking straw is preferably formed in one piece with the tube. In the alternative, the tube is inserted into the lower end of the drinking straw or is attached thereto. The suction tube, in turn, is attached to the tube, so that, together with the latter, it forms the drinking valve. The passage channel extends through the drinking straw, the tube and the suction tube. The suction tube forms the wall of the passage channel, to which the outer rim of the through-flow opening abuts so as to form a seal.

According to a further design, the tube has an edge, which protrudes outwards, at a distance from its lower end, and up to which the suction tube is pushed onto the tube. The edge is a stop for the suction tube, which facilitates the assembly of the drinking container.

According to a further design, the tube, above the diaphragm, has at least one circumferential sealing element on the outside, which abuts the wall of the suction tube so as to form a seal. The aspiration of air is prevented particularly effectively by means of the sealing element.

According to a further design, the drinking straw is guided through the bottom wall of the drinking attachment so as to form a seal. According to a further design, the drinking straw is held in a holder for drinking straws of the bottom wall so as to form a seal. According to a further design, the holder is a tube, which protrudes from the inside (underside) of the bottom wall, comprising an upper opening to the outside (upper side) and a lower opening to the interior, into which the drinking straw is clamped.

According to a further design, the drinking straw has a circumferential flange on the outside, which abuts a sealing surface on one side of the bottom wall so as to form a seal. The flange preferably abuts a sealing surface on the inside of the bottom wall. A particularly good sealing of the drinking straw is attained through this in the bottom wall.

According to a further design, the flange is conical and abuts a conical sealing surface of the bottom wall so as to form a seal, which has a passage hole, through which the drinking straw is guided.

According to a preferred design, the flange is soft elastic and the sealing surface of the bottom wall has a venting hole, which extends from the outside to the inside of the bottom wall, wherein the flange abuts the sealing surface so as to form a seal, when ambient pressure prevails in the interior, and the flange lifts off the sealing surface, when a suction underpressure is present in the interior. A venting valve is realized through this.

According to another design, the drinking straw is formed in one piece with the drinking attachment. The assembly and disassembly is facilitated through this and a particularly good sealing of the drinking straw is attained in the bottom wall. The drinking vessel can additionally be provided with a venting valve.

The drinking straw is preferably made of a soft elastic material. The drinking straw is preferably made of a soft elastic material in one piece with the tube. The suction tube is preferably made of a soft elastic or of a hard elastic plastic.

According to another design, the drinking element is a mouthpiece, which is cylindrical or which tapers to the outer end, and the tube is arranged in a cavity of the mouthpiece, wherein the outer rim of the flow-through opening abuts a wall of the mouthpiece so as to form a seal, when ambient pressure is present at the drinking opening, and the outer rim of the flow-through opening lifts off the wall of the mouthpiece, when a suction underpressure is present at the drinking opening. In the case of this design, the drinking valve is embodied with a mouthpiece at a drinking vessel. The wall of the mouthpiece is the wall of the passage channel, which the outer rim of the flow-through opening abuts so as to form a seal.

According to a preferred design, the mouthpiece has a cylindrical holder on the inside, into which the tube is clamped. The holder defines the cavity, in which the tube is arranged. The hollow cylindrical holder forms the wall of the mouthpiece for the abutment of the outer rim of the through-flow opening so as to form a seal.

According to a preferred design, the holder protrudes downwards from the inside of the bottom wall. The assembly and disassembly of the tube is facilitated through this.

According to a further design, the tube has a valve flange, on the lower rim, which abuts the lower rim of the holder, wherein the lower rim of the holder and/or the upper side of the valve flange has at least one continued flow channel, which extends in radial direction. The valve flange facilitates the assembly and disassembly of the tube. The tube can hereby be gripped on the valve flange. The passage of liquid is ensured by the continued flow channels. This design further prevents that pressure peaks act on the diaphragm when shaking the drinking vessel and that the drinking valve opens unintentionally.

According to a further design, the tube has a circumferential collecting channel for this purpose above the valve flange and below the through-flow opening.

According to a further design of a drinking vessel comprising a drinking element, which is formed as mouthpiece, and a tube in a cavity of the mouthpiece, the tube has a second depression in the outside of a wall, the bottom of the second depression is a second diaphragm, the tube has at least one continued flow channel on the outside, which extends from the second depression to the lower end of the tube, and the tube has a further continued flow channel on the outside, which connects the second depression to the depression. When the drinking vessel is held upside down, liquid flows through the continued flow channel into the second depression, the bottom of which is the second diaphragm. When shaking the drinking vessel, pressure peaks act on the second diaphragm and are absorbed by the latter, in a manner similar to a hydraulic damper. As a result, the pressure peaks do not reach the diaphragm or reach it only to a weakened extent, through the further continued flow channel. An unintentional opening of the diaphragm and liquid flowing out through the flow-through opening and out of the mouthpiece, is prevented through this. When applying suction to the mouthpiece, the underpressure is applied to the diaphragm and it bulges into the cavity. The rim of the through-flow opening lifts off the wall of the mouthpiece through this and liquid can systematically flow out of the mouthpiece.

According to a further design, the second depression is arranged diametrically opposite the depression in the side wall of the tube. This is advantageous for the formation of the first diaphragm and of the second diaphragm. Pressure peaks are further kept away from the diaphragm in an advantageous manner through this.

According to a further design, the tube has a circumferential flange on the lower end, which abuts a sealing surface on the inside of the bottom wall so as to form a seal, the bottom wall has a venting hole, which extends from the outside to the inside of the bottom wall, wherein the flange abuts the sealing surface so as to form a seal, when ambient prevails in the interior, and the flange lifts off the sealing surface, when a suction underpressure is present in the interior. The flange is soft elastic for this purpose. A venting valve is realized through this. The flange is preferably formed in one piece with the tube. The tube as a whole preferably consists of soft elastic material. This embodiment has a particularly simple construction. It facilitates the assembly and disassembly as well as the cleaning of the valves.

According to a further design, the flange is conical and abuts a conical sealing surface on the inside of the bottom wall so as to form a seal, when ambient pressure prevails in the interior. This design favors the reaching of a defined sealing position, when inserting the tube into the cavity of the mouthpiece.

According to a further embodiment, the sealing surface is arranged on the lower end of the holder. In the case of this design, the venting hole extends from the lower end of the holder in axial direction through the wall of the holder and through the bottom wall to the outside of the bottom wall.

According to a further design of a drinking vessel comprising a drinking element, which is formed as mouthpiece, and a tube in a cavity of the mouthpiece, the drinking attachment has a second passage channel, which extends from the outside of the bottom wall to the inside of the bottom wall, in which a venting valve is arranged, which opens, when a suction underpressure is present in the interior and which is closed, when ambient pressure prevails in the interior, wherein the venting valve comprises a second tube, which is closed on the top and open on the bottom, which, in a wall, has at least a second flow-through opening, which connects the inside of the second tube to the outside of the second tube, wherein the wall of the second tube, at least in the area of the second flow-through opening, is formed as soft elastic, third diaphragm, the second tube abuts a wall of the second flow-through channel so as to form a seal with the outer rim of the second flow-through opening, when ambient pressure is present on its inside, and the third diaphragm bulges inwards when a suction underpressure is present on the inside, so that the outer rim of the second flow-through opening moves away from the wall of the second flow-through channel. A venting valve is realized through this, which, according to the drinking valve, has a tube, which is arranged in a passage channel. It is advantageous that the second tube is produced by means of injection molding in only one operation and can be assembled by simply inserting the second tube into the second passage channel. The venting valve can furthermore disassembled easily and can be cleaned easily in the disassembled state, so that beverage residues do not remain on the venting valve. As a result, the venting valve opens and closes reliably and contaminations of the beverage are avoided. The extensive separate creation of slits of common slit valves, the extensive assembly of common non-return valves and the difficult and often unsatisfactory cleaning of common venting valves can be forgone. Due to the fact that the second tube is open to the bottom, pressure peaks in the interior of the drinking vessel have the effect that the rim of the second flow-through opening abuts the second wall of the passage channel more firmly and seals even better. This additionally counteracts an escape of liquid through the venting valve when the vessel is shaken.

According to a further design, the third diaphragm is the bottom of a third depression in the outside of the wall of the second tube.

According to a further design, the drinking attachment has a hollow cylindrical holder on the inside, into which the second tube is inserted, and the bottom wall has a venting hole, which connects the outside of the bottom wall to the inside of the bottom wall inside the holder. The second hollow cylindrical holder defines the cavity, in which the second tube is arranged. The second hollow cylindrical holder forms the wall of the second passage channel for the abutment of the outer rim of the second through-flow opening so as to form a seal. According to a preferred design, the second holder protrudes downwards from the inside of the bottom wall. The assembly and disassembly of the second tube is facilitated through this.

According to a further design, the second tube has a second valve flange, which abuts the lower rim of the second holder, on the lower rim. The valve flange facilitates the assembly and disassembly of the second tube. The second valve flange facilitates the gripping and the assembly and disassembly of the second tube in the drinking attachment.

According to a further design, the second tube has at least a second continued flow channel on the outside, which extends from the third diaphragm to the upper end of the second tube. Air can continue to flow better through the second continued flow channel, when the venting valve is open.

According to a further design, the tube and/or the second tube is connected to a gripping tab on the lower end. The gripping tab facilitates the assembly and disassembly of the tube and/or of the second tube. According to a preferred design, the gripping tab is oriented in a vertical plane.

According to a further design, the tube and the second tube are connected to one another by means of a bridge. According to a further design, they are provided with a common gripping tab. The assembly and disassembly of the first and second tube in the drinking attachment is facilitated through this.

The invention will be discussed in more detail below by means of the enclosed drawings of exemplary embodiments:

Figure 1:
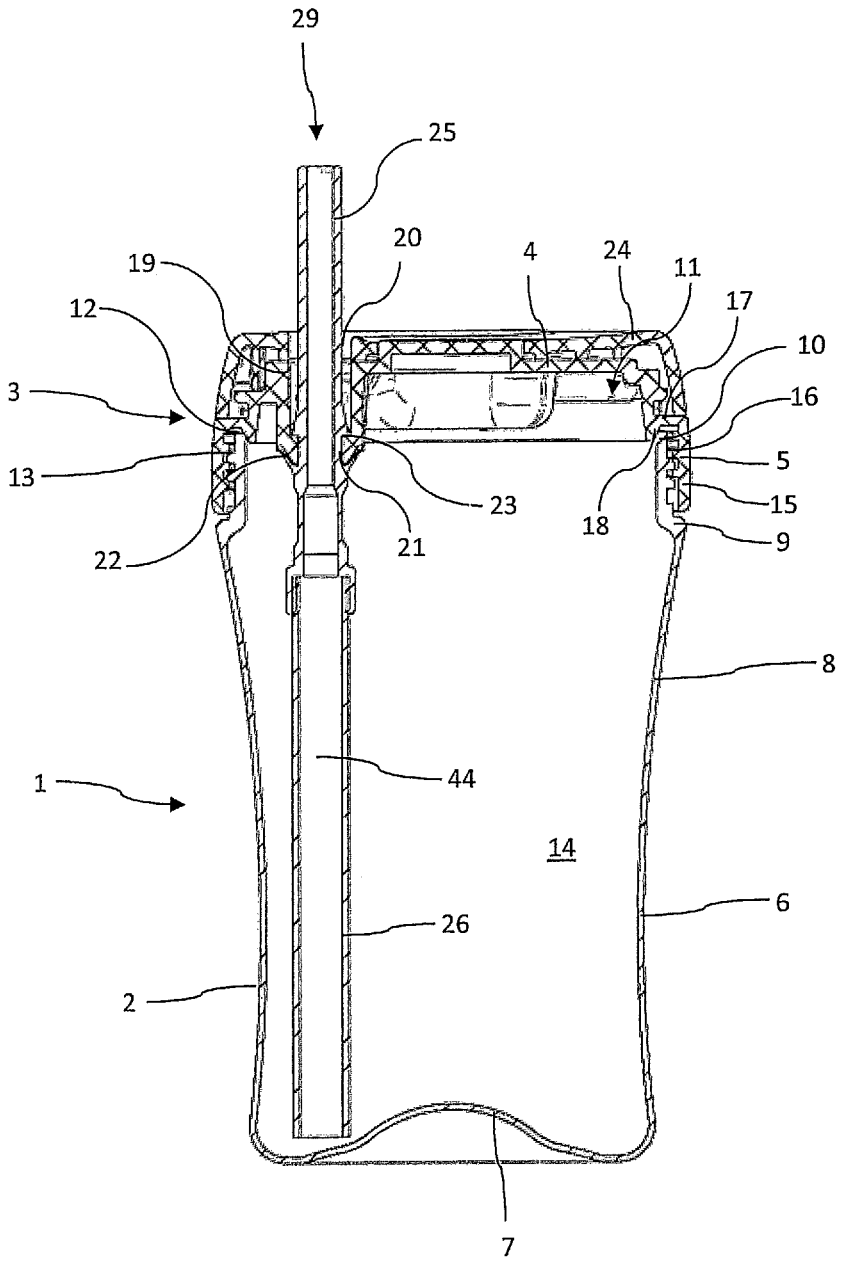
FIG. 1 shows a common drinking vessel comprising a drinking straw in a vertical section.

In this application, the information "top" and "bottom" as well as "horizontal" and "vertical" as well as information derived therefrom, such as "upper side" and "underside" refer to an orientation of the drinking vessel, in the case of which the container axis is oriented vertically, the drinking attachment is arranged on the top and the drinking container is arranged on the bottom.

In the following discussion of different exemplary embodiments, components comprising the same name are further provided with corresponding reference numerals.

By means of FIG. 1, the basic structure of the drinking vessel 1 is initially discussed by means of a common drinking vessel.

According to FIG. 1, the drinking vessel 1 has a drinking container 2 in the form of a drinking cup and a drinking attachment 3 comprising a bottom wall 4 and a threaded ring 5 connected thereto.

The drinking container 2 has an elongated bottle body 6 comprising a bottle bottom 7 and a substantially sleeve-shaped bottle side wall 8. On the upper end of the bottle side wall 8, the drinking container 2 has a shoulder 9, from the inner circumference of which a cylindrical container neck 10 (bottle neck) rises upwards. The bottle neck 10 surrounds a circular container opening 11.

The upper front surface of the bottle neck 10 forms a circular ring-shaped opening rim 12, which surrounds the container opening 11. The bottle neck 10 supports an external thread 13 on the outer circumference.

The drinking container 2 defines an interior 14, which can be filled with a beverage.

In a cylindrical jacket part 15, the threaded ring 5 of the drinking attachment has an internal thread 16. The upper rim of the jacket part 15 is connected to a threaded ring flange 17, which protrudes inwards. A circumferential sealing profile 18 protrudes downwards from the inner rim of the threaded ring flange 17. The outside of the sealing profile 18 is conical. By screwing the drinking attachment 3 onto the drinking container 2, the conical outer surface can be pressed against the inner rim of the container opening 11 so as to form a seal.

The bottom wall 4 has a hollow cylindrical holder 19 for a drinking straw. In the example, the holder 19 protrudes downwards from the underside of the bottom wall 4. Approximately at the level of the upper side of the bottom wall 4, it has an upper opening 20, and a lower opening 21 on the lower end. On the lower end, the holder 19 has a conical sealing surface 22, which tapers downwards. Above the sealing surface 22, the holder 19 has a circumferential ledge 23 on the inside.

At least one venting hole extends in axial direction through the sealing surface 22, wherein the upper end of the venting hole is open into the cavity of the holder 19 and thus towards the surrounding area, and the lower end of the venting hole is open towards the interior 14.

In the example, a cap 24 of soft elastic material is attached to the upper side of the drinking attachment 3, e.g. by snapping on.

According to FIG. 1, a common drinking straw 25, into which a common suction tube 26, which is open on the bottom, is clamped on the bottom, is held in the drinking attachment 3. A passage channel 44 extends through drinking straw 25 and suction tube 26. The passage channel 44 can be blocked by bending over the drinking straw 25.

The drinking vessel 1 according to the invention differs from the common drinking vessel by the design of the drinking straw 25 and of the suction tube 26. A drinking straw 25 of a drinking vessel 1 according to the invention will be discussed by means of FIGS. 2 and 3.

The drinking straw 25 is smooth on the top and is formed in one piece with a tube 27, which forms a valve element. The lower end of the tube is closed by means of a front wall 28. On the upper end, the drinking straw 25 has a drinking opening 29.

In the outside of its side wall 30, the tube 27 has a depression 31, which has the geometric shape of a segment of a cylinder shell. In the area of the depression 31, the wall thickness of the side wall 30 is so small that the bottom of the depression 31 forms a soft elastic, deformable diaphragm 32. In the example, the wall thickness of the side wall 30 in the area of the depression is 0.3 mm and 1.3 mm outside of the depression.

The drinking straw 25 and the tube 27 are made in one piece of a soft elastic plastic, e.g. of polyurethane, silicon or of a thermoplastic elastomer.

A base 33 protrudes to the outside from the outside of the diaphragm 32. The base 33 is a massive, elongated element, which is oriented in longitudinal direction of the tube 27, comprising a rectangular cross section. Its shape is similar to that of a feather key.

A flow-through opening 34 extends across the diaphragm 32 and the base 33. The through-flow opening 34 is open on the outside of the base 33 and is closed on the inside of the side wall 30. The outer rim of the flow-through opening 34 is located at a sealing element 35, which protrudes annularly from the outside of the base 33. The height of the base 33 and of the sealing element 35 exceeds the depth of the depression 31, so that the sealing element 35 protrudes outwards on both sides of the depression 31 with respect to the jacket of the tube 27.

At a distance from its lower end, the tube 27 has an edge 36, which protrudes outwards. Between edge 36 and diaphragm 32, the tube 27 has a plurality of circumferential sealing elements 37 on the outside.

Above the edge 36, the tube 27 has a flange 38, which has the shape of a hollow truncated cone and which widens to the top. Above the flange 38, a circumferential upper edge 39 is arranged on the outside of the drinking straw 25. In the example, said upper edge is formed on the lower end of a cone section 40, which expands downwards.

On the outside of the tube 27, an axially oriented continued flow channel 41 is present, which connects the underside of the depression 31 to the lower end of the tube 27.

The drinking straw 25 is inserted into the holder 19 from below and is pulled through the holder 19 with the cone section 40, until the flange 38 abuts the sealing surface 22 so as to form a seal and the upper edge 39 engages over the ledge 23 in the holder 19.

A suction tube 26 is further clamped onto the tube 27 from below, until it abuts the edge 36.

Figure 2:
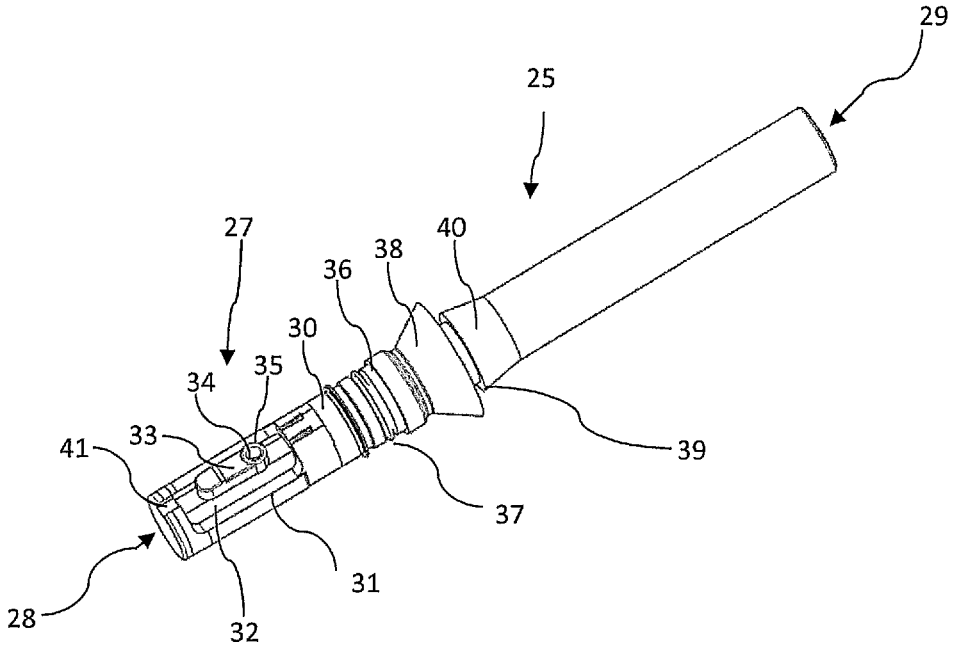
FIG. 2 shows a drinking straw of a drinking vessel according to the invention in a perspective view diagonally from the side.
Figure 3:
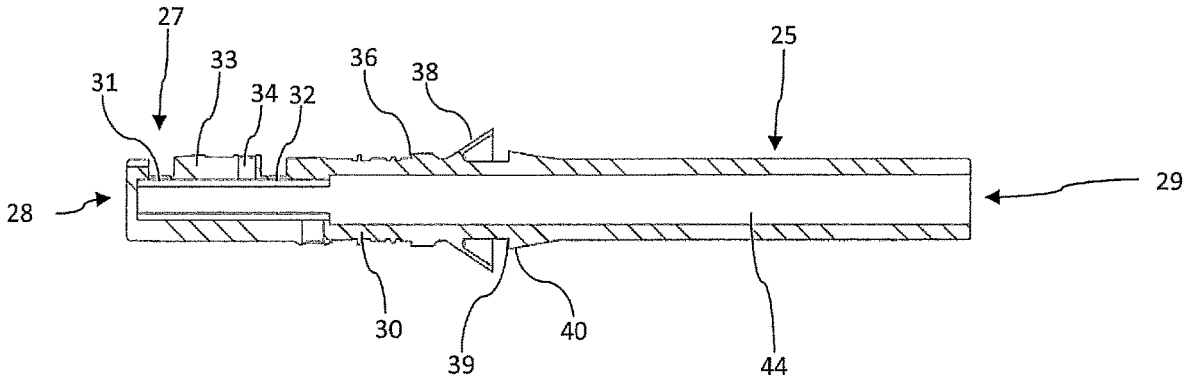
FIG. 3 shows the same drinking straw in a longitudinal section.
Figure 4:
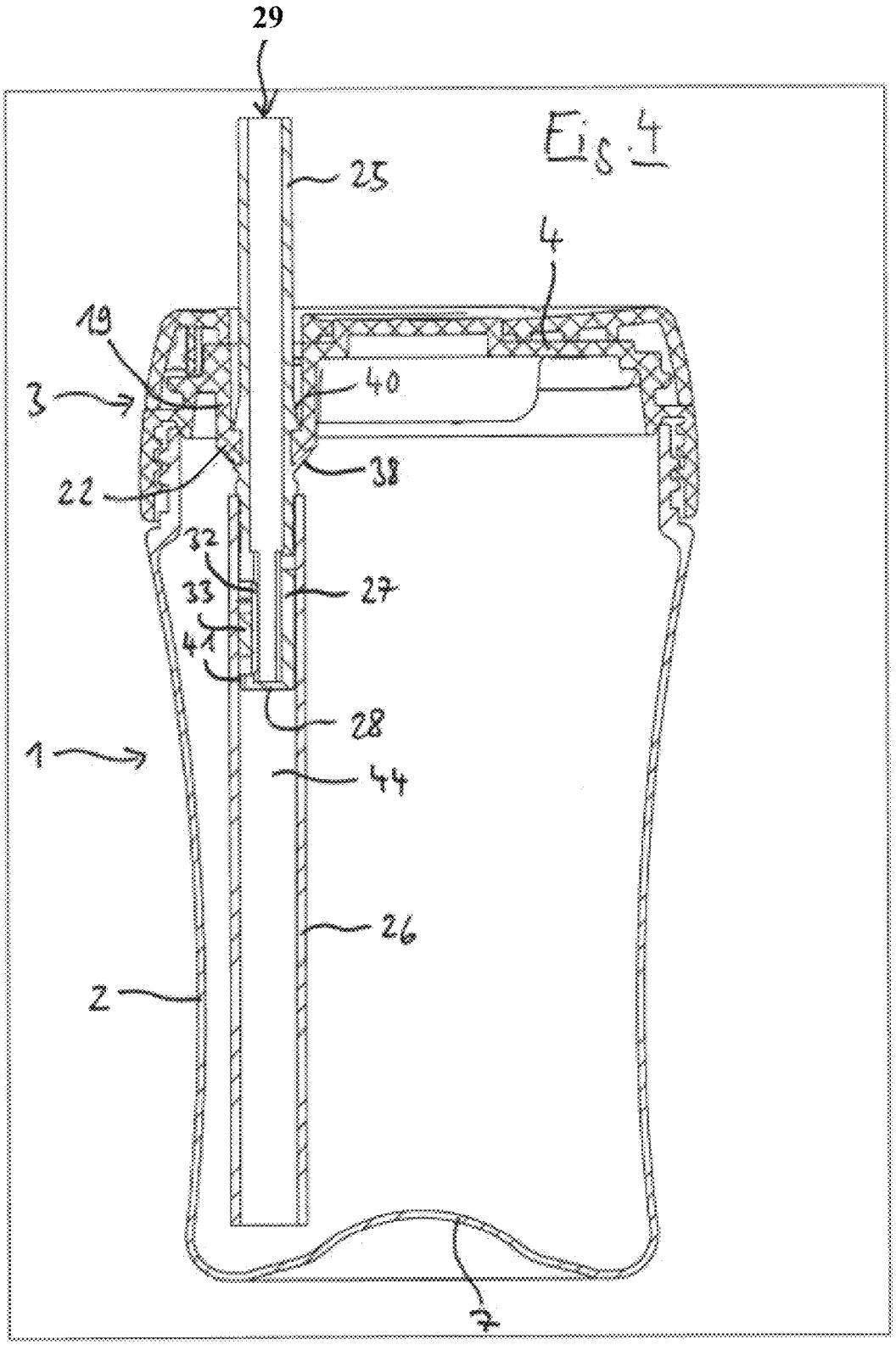
FIG. 4 shows a drinking vessel according to the invention comprising drinking straw according to FIGS. 2 and 3 in a vertical section.

FIG. 4 shows the drinking vessel according to the invention comprising drinking straw 25 and suction tube 26 according to FIGS. 2 and 3.

Figure 5:
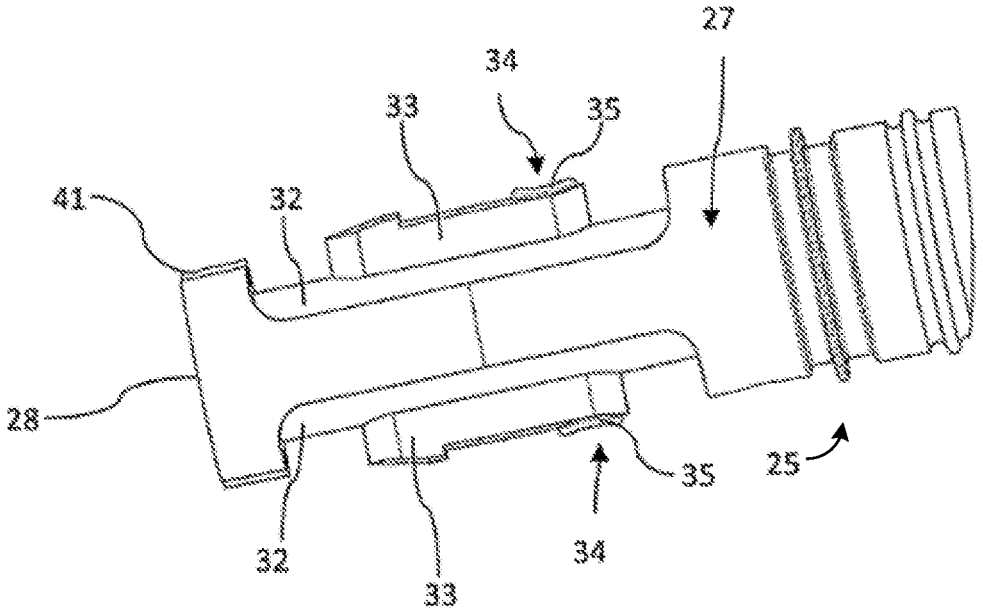
FIG. 5 shows the lower end of another design of the drinking straw in side view.

FIG. 5 shows a different design of the drinking straw 25, in the case of which the tube 27 is in each case provided with a diaphragm 32, a base 33 and a flow-through opening 34 on diametrically opposite sides.

Figure 6:
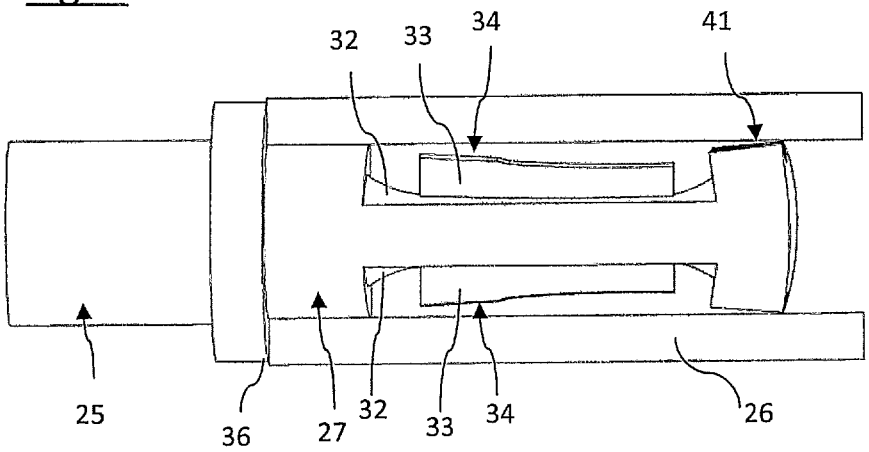
FIG. 6 shows the lower end of the same drinking straw, inserted into a suction tube in response to suction in a longitudinal section.

FIG. 6 shows the suction tube being slid onto the tube 27 to the edge 26 for the exemplary embodiment of the drinking straw 25 of FIG. 5.

When ambient pressure is present at the drinking opening 29 on the top on the drinking straw 25, the base or the bases 37 is or are pressed against the wall of the suction tube with the outer rim of the through-flow opening 34 so as to form a seal. Liquid can then not flow out of the interior.

According to FIG. 6, a suction underpressure is present on the drinking opening 29. The diaphragms 37 thus bulge inwards and the bases 33 lift off the wall of the suction tube 26 with the outer rim of the flow-through opening 34. In this state, liquid can be removed from the interior 14 through the drinking straw 25. The continued flow channel 41 hereby facilitates liquid to continue to flow from the suction tube 26 to the flow-through opening 34.

Figure 7:
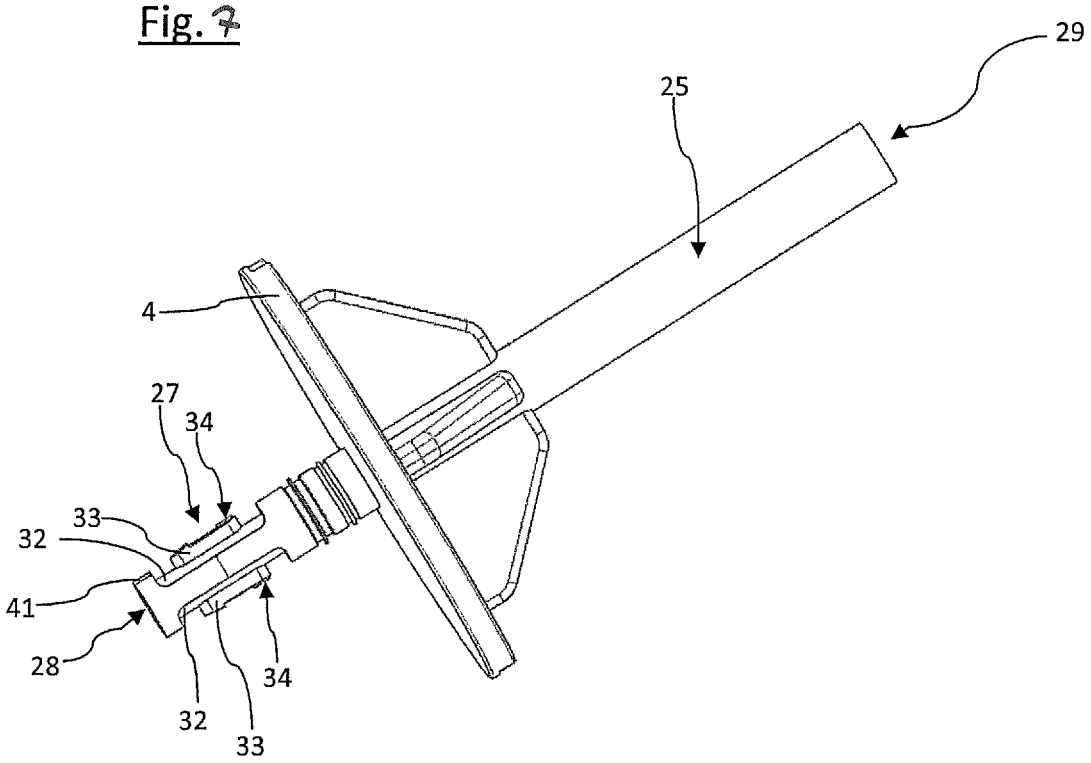
FIG. 7 shows a drinking straw formed in one piece with a bottom wall in side view.

The design of FIG. 7 differs from what has been described above in that the drinking straw 25 and the tube 27 are formed in one piece with the bottom wall 4 of the drinking attachment 3. In the case of this design, the bottom wall 4 can be screwed to the upper rim of the drinking container 2 by means of an additional threaded ring.

Figure 8:
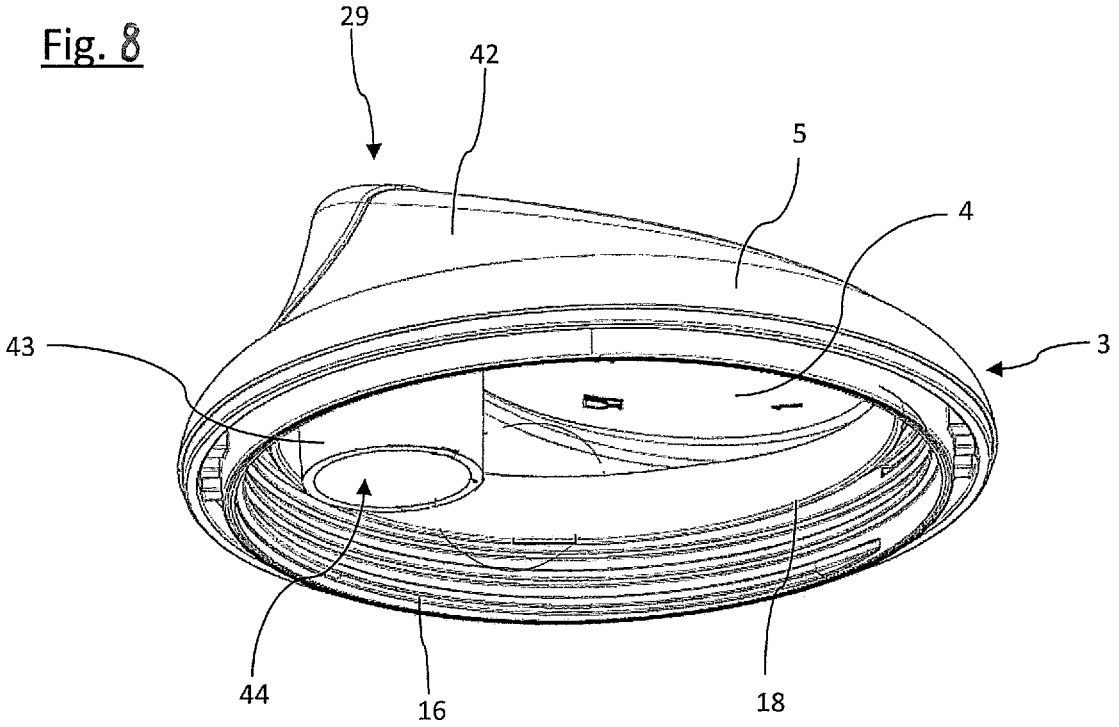
FIG. 8 shows a drinking attachment of a drinking vessel comprising a mouthpiece in a perspective view from below.

According to FIG. 8, the drinking attachment 3 has a mouthpiece 42 on the outside of the bottom wall 4. On the inside, the mouthpiece 42 is defined by a hollow cylindrical holder 43, which protrudes downwards from the underside of the bottom wall 4. On the outside, the drinking attachment 3 has a cylindrical jacket part 5, which is provided with an internal thread 13.

On the upper end, the mouthpiece 42 has at least one drinking opening 29, which is connected to the cavity in the holder 43, which forms the passage channel 44.

Figure 9:
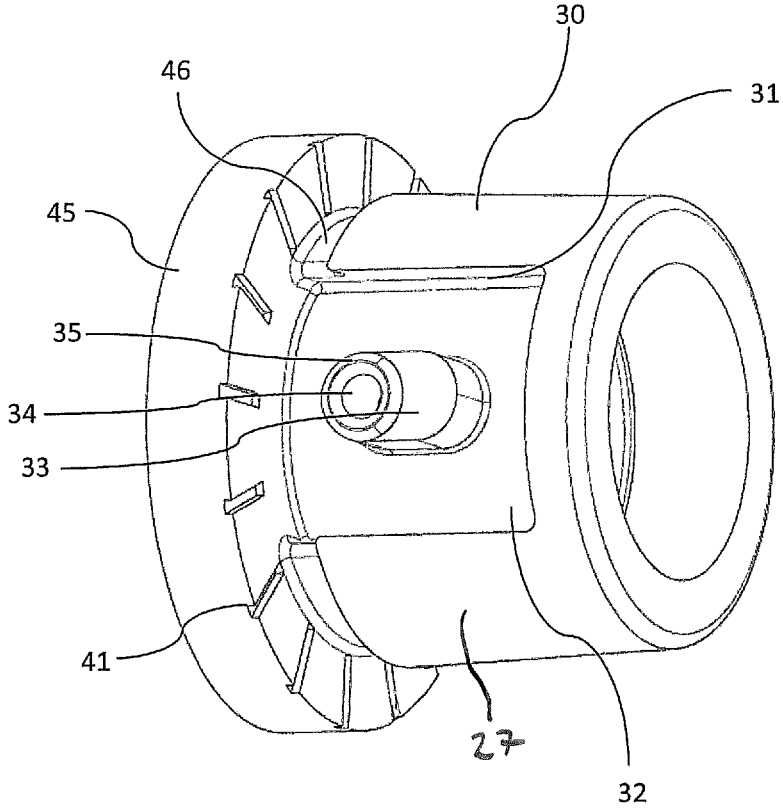
FIG. 9 shows a valve element for a drinking vessel comprising a mouthpiece in a perspective view from the side.

According to FIG. 9, a valve element has a tube 27, which is open on the top and closed on the bottom. In a side wall 30, a soft elastic diaphragm 32 is formed in the area of a depression 31. From the outside of the diaphragm 32, a circular ring-shaped sealing element 35 protrudes outwards on a base 33. A flow-through opening 34 extends through the sealing element 35 and across the diaphragm 32. The flow-through opening 34 is open towards the outside and towards the inside of the tube 27.

On the lower end, the tube 27 is connected to a circumferential valve flange 45, which protrudes radially outwards. The valve flange 45 is substantially circular disk-shaped. On the upper side, it has radially extending continued flow channels 41. A collecting channel 46, in addition to the valve flange 45, further circulates on the lower end of tube 27 on the outside of the tube.

Figure 10:
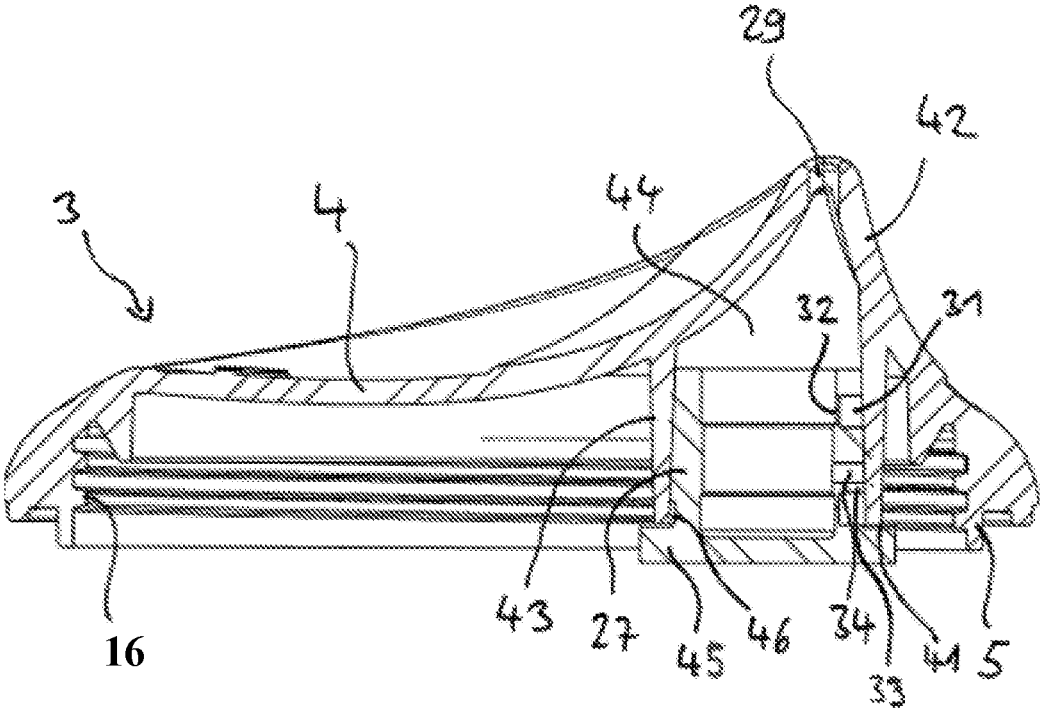
FIG. 10 shows the drinking attachment comprising the inserted valve element in closed state in a vertical section.
Figure 11:
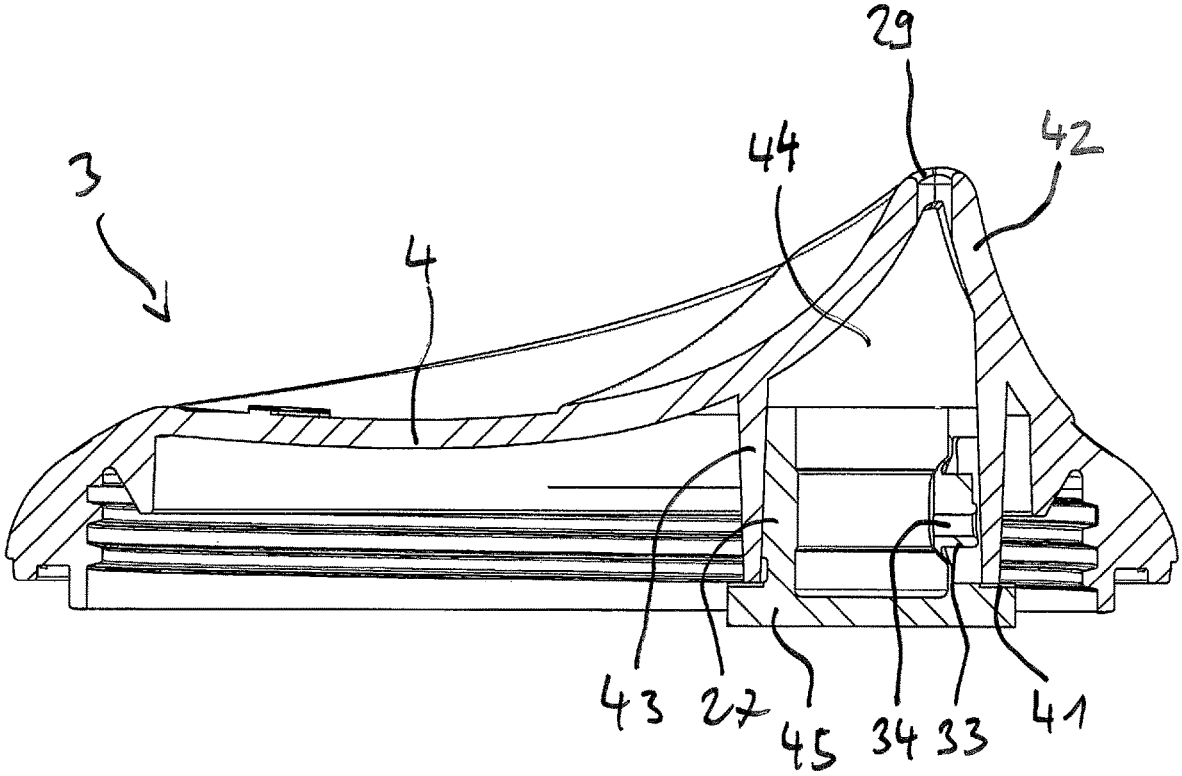
FIG. 11 shows the drinking attachment with inserted valve element in the open state in a vertical section.
Figure 12:
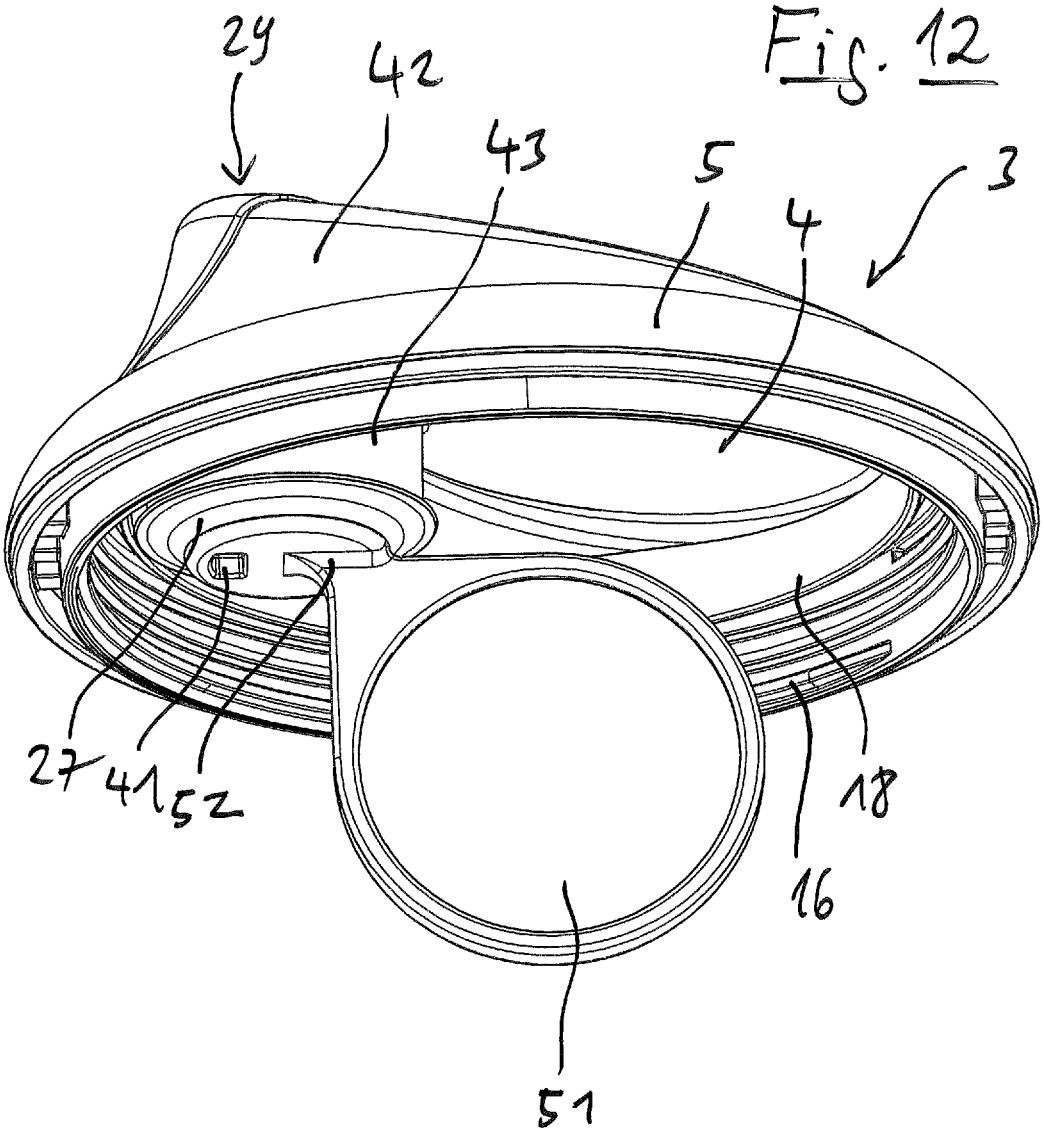
FIG. 12 shows a further drinking attachment of a drinking vessel comprising a mouthpiece comprising inserted valve element in a perspective view diagonally from below and from the side.
Figure 13:
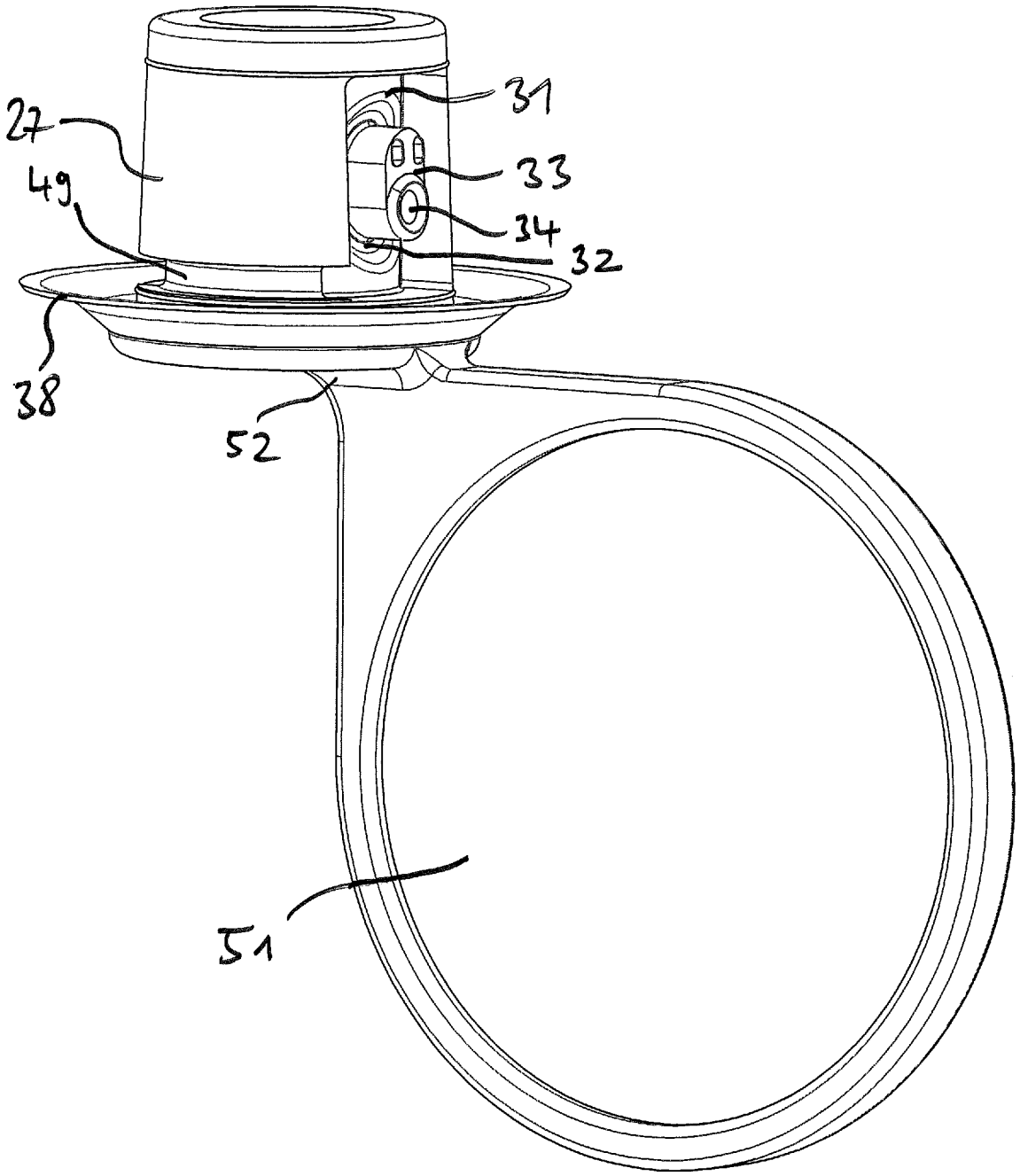
FIG. 13 shows the same valve element in a perspective view diagonally from the top and from the side.

The tube 27 can be clamped into the holder 43 of the drinking attachment 3 from below, until the valve flange 45 abuts the lower rim of the holder 43. The outer rim 35 of the flow-through opening 34 then abuts the inside of the holder 43 so as to form a seal. Liquid in a drinking container 2, onto which the drinking attachment 3 is screwed, can then not escape through the mouthpiece 42. This situation is shown in FIG. 10. When applying suction to the mouthpiece 42, the diaphragm 32 bulges inwards as a result of the internal pressure in the mouthpiece 42, so that the outer rim 35 of the through-flow opening 34 is released from the wall of the holder 43. As a result, liquid can flow through the continued flow channel 41, the flow-through opening 34, the tube 27, and the drinking opening 29 of the mouthpiece 42. This situation is shown in FIG. 11. If suction is no longer applied to the mouthpiece 42, the outer rim 35 of the flow-through opening 34 abuts the holder 43 so as to form a seal again.

The exemplary embodiment of FIGS. 12 to 15 differs from the exemplary embodiment of FIGS. 9 to 11 in that, on the outside of its side wall 30, the tube 27 has a second depression 47, the bottom of which is a second diaphragm 48. The second depression 47 is arranged diametrically opposite the depression 31 in the side wall 30. On the outside, the tube 27 has a continued flow channel 41, which extends in axial direction and which extends from the second depression 47 to the lower end of the tube 27. The tube 27 has a further continued flow channel 49, which connects the second depression 47 to the depression 31 in circumferential direction.

A further difference is that the tube 27 has a circumferential flange 38 on the lower end. The flange 37 has the shape of a hollow truncated cone and widens from bottom to top. The flange 38 is preferably formed of soft elastic material in one piece with the tube 27. Its wall thickness is so small that it can be easily deformed.

On its sealing surface 22, the flange 38 abuts the lower end of the hollow cylindrical holder 43. A venting hole 50, which extends axially through the wall of the holder 43 and the bottom wall 4, connects the sealing surface 22 to the outside of the bottom wall 4. The sealing surface 22 is conical.

Finally, an approximately circular disk-shaped gripping tab 51 is connected to the lower end of the tube 27 via a web 52. The gripping tab 51 is arranged in a vertical plane.

The tube 27 is preferably made of soft elastic material in one piece with the gripping tab 51.

Figure 14:
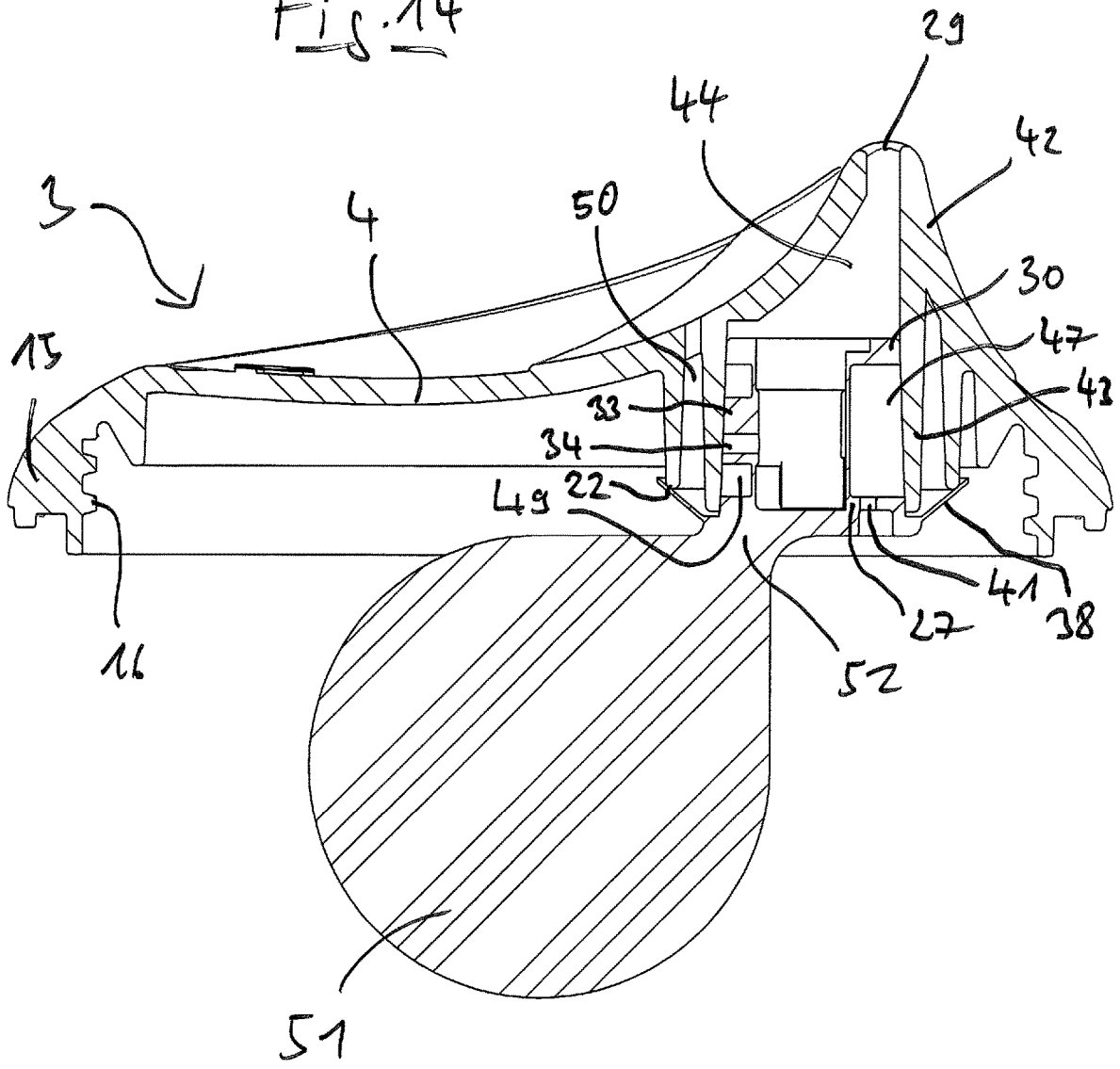
FIG. 14 shows the same drinking attachment comprising inserted valve element with closed drinking valve and venting valve in a vertical section.

FIG. 14 shows a situation, in the case of which suction is not applied to the mouthpiece 42 and no underpressure prevails in the interior 14 of the drinking container 2. In this situation, the outer rim of the flow-through opening 34 of the tube 27 abuts the wall of the holder 43 so as to form a seal. Liquid cannot flow out of the interior 14 through the mouthpiece 42.

The flange 38 further abuts the sealing surface 22 so as to form a seal, so that air can also not continue to flow through the venting hole 50 into the interior 14.

Figure 15:
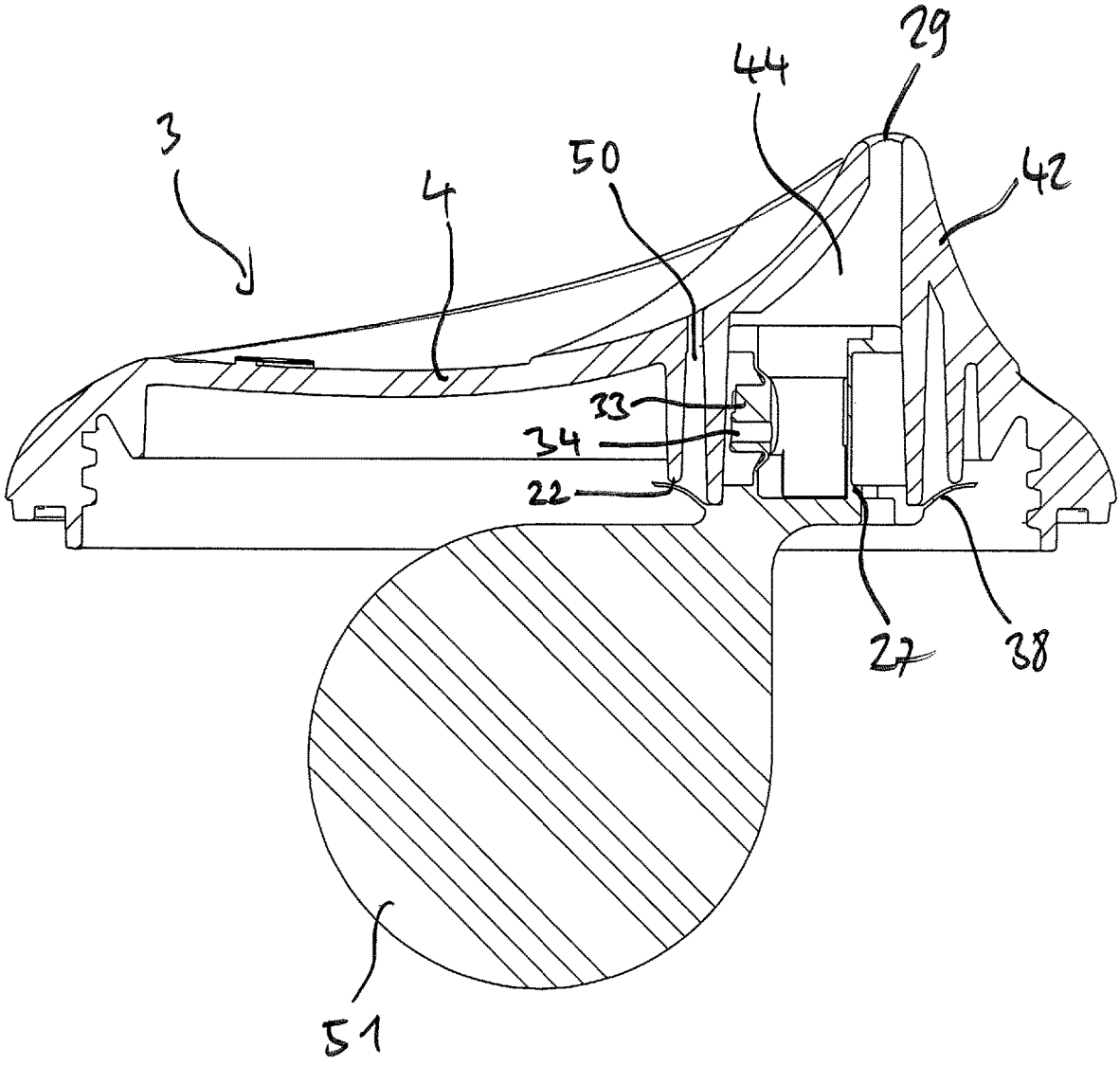
FIG. 15 shows the same drinking attachment comprising inserted valve element with open drinking valve and venting valve in a vertical section.
Figure 16:
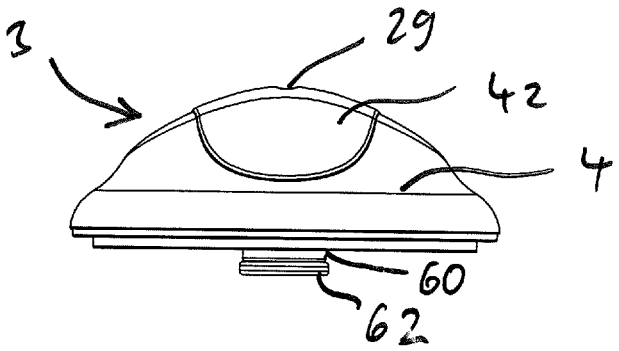
FIG. 16 shows a further drinking attachment comprising drinking valve and separate venting valve in a front view.
Figure 17:
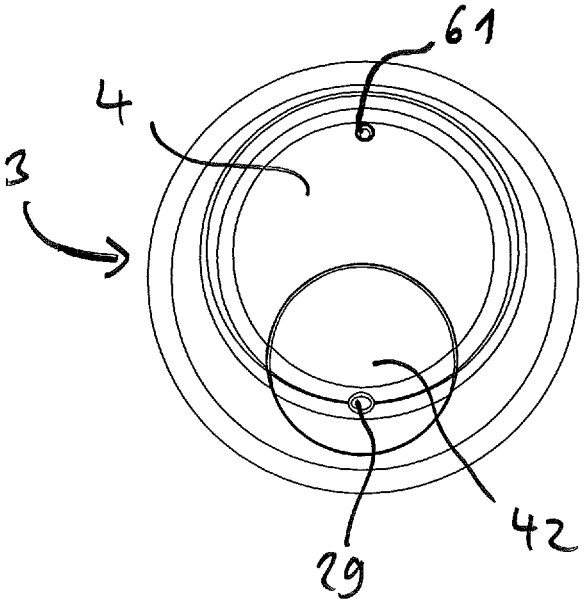
FIG. 17 shows the same drinking attachment comprising valve elements in the top view.

FIG. 15 shows a situation, in which a suction underpressure is present at the mouthpiece 42 and the suction underpressure prevails in the interior 14 of the drinking container. Due to the suction underpressure, the diaphragm 32 is deflected inwards and the outer rim of the flow-through opening 34 is released from the wall of the holder 43. As a result, liquid can flow through of the continued flow channel 48, the second depression 47, the further flow-through channel 49, the depression 31, the flow-through opening 34, the tube 27 and the mouthpiece 42. As a result of the underpressure, the screen-like flange 38 (venting screen) lifts off the sealing surface 2 and air can continue to flow from the outside into the interior 14 through the venting hole 50.

Pressure peaks caused by liquid, which reaches into the second depression 47 by means of shaking, are absorbed by the second diaphragm 48, so that they do not unintentionally open the drinking valve.

The exemplary embodiment of FIGS. 16 to 21 differs from the exemplary embodiment of FIGS. 8 to 11 in that, in addition to the drinking valve, a venting valve, which is separated therefrom, is present. For this purpose, the drinking attachment 3 has a second flow-through channel 53, which extends from the outside of the bottom wall 4 to the inside of the bottom wall 4. The venting valve is arranged in the second passage channel 53.

The venting valve has a second tube 54, which is closed on the top and open on the bottom and which, in a side wall 55, has at least a second flow-through opening 56, which connects the inside of the second tube 54 to the outside of the second tube 54. In the area of the second flow-through opening 56, the side wall 55 of the second tube 54 is formed as soft elastic, third diaphragm 57. The third diaphragm 57 is the bottom of a third depression 58 in the outside of the side wall 55.

On the outside, the second tube 54 has a second continued flow channel 59, which extends from the third diaphragm 57 to the upper end of the second tube 54.

On the inside, the drinking attachment 3 has a second hollow cylindrical holder 60, into which the second tube 54 is inserted. The bottom wall 4 has a venting hole 61, which connects the outside of the bottom wall to the inside of the bottom wall inside the second holder 60.

On the lower rim, the second tube 54 has a second valve flange 62, which abuts the lower rim of the second holder 60.

The two valve elements or tubes 27, 54, respectively, can have the same diameters. They can further have different diameters in order to prevent mix-ups. Both valve elements can also be connected to one another via a bridge or via a common gripping tab.

Figure 18:
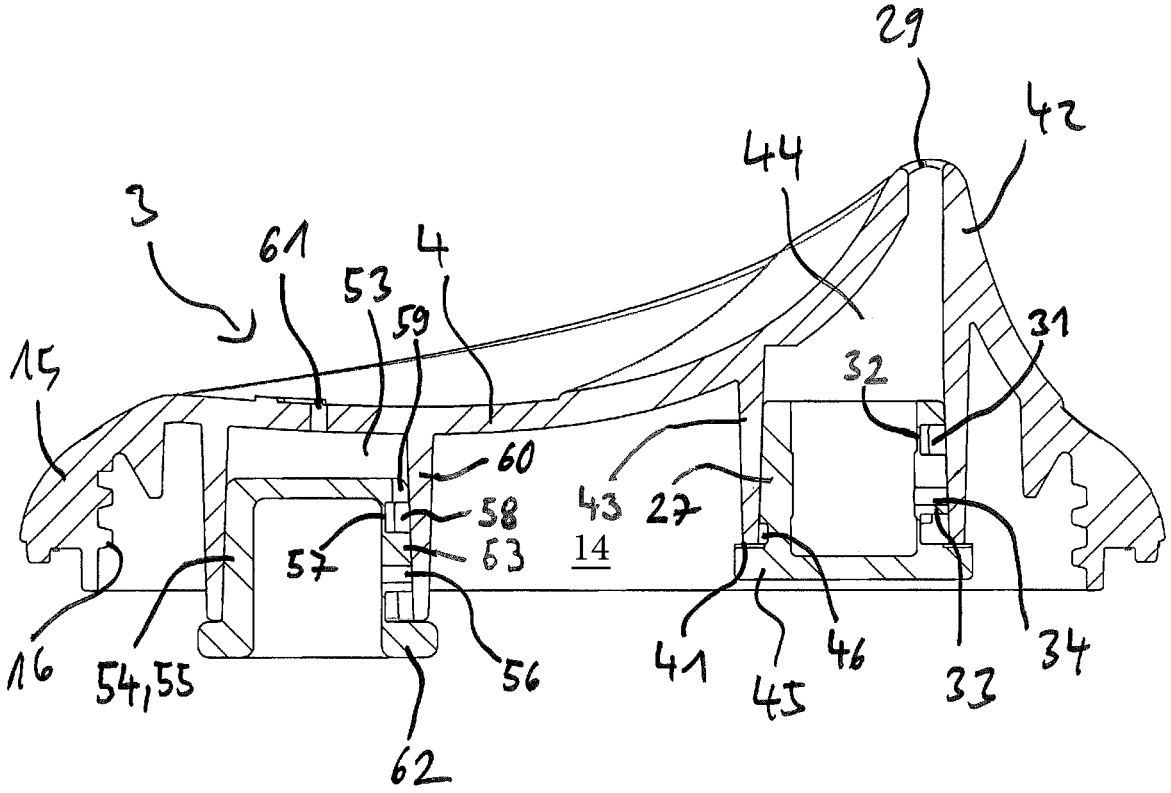
FIG. 18 shows the same drinking attachment comprising valve elements in closed state in a vertical section.

FIG. 18 shows a situation, in the case of which normal pressure prevails in the mouthpiece 42 and in the interior 14. As a result, the outer rim of the flow-through opening 34 of the drinking valve and the outer rim of the second flow-through opening 56 on the outside of a second base 63 of the venting valve abuts the wall of the holder 43 or second holder 60, respectively, so as to form a seal. Liquid can neither flow out, nor can air continue to flow.

Figure 19:
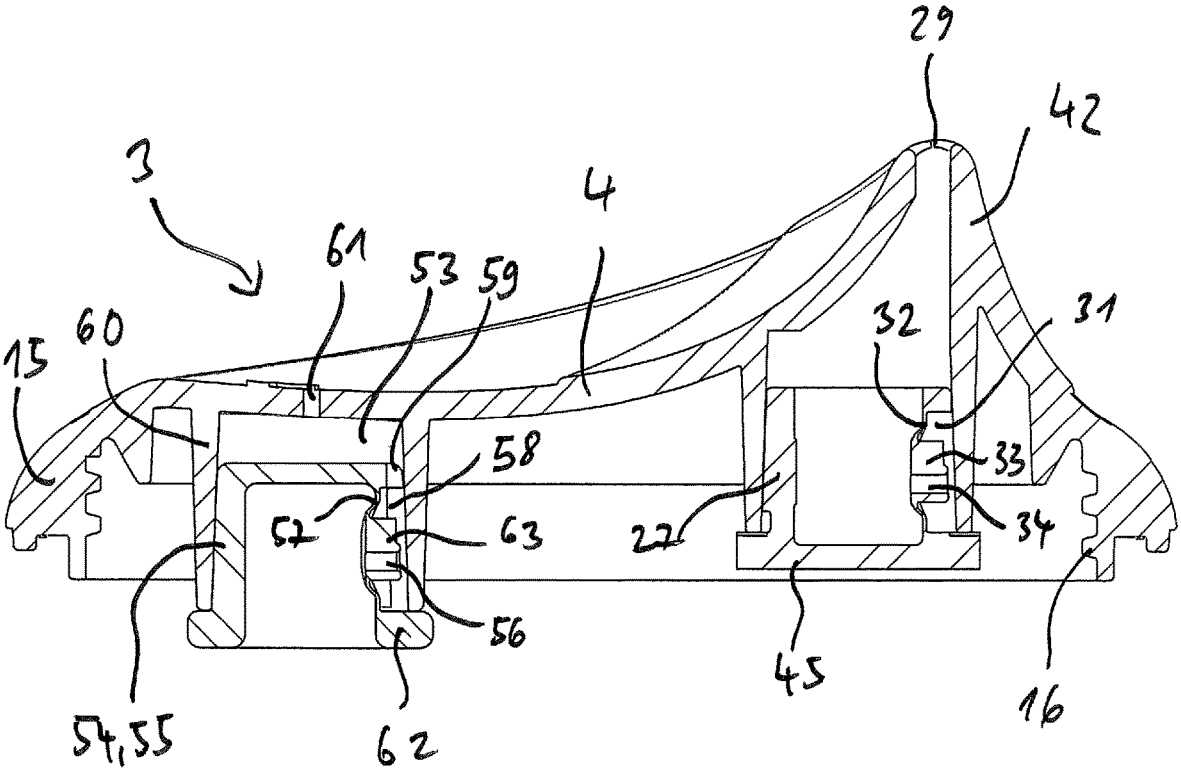
FIG. 19 shows the same drinking attachment comprising valve elements in the open state in a vertical section.
Figure 20:
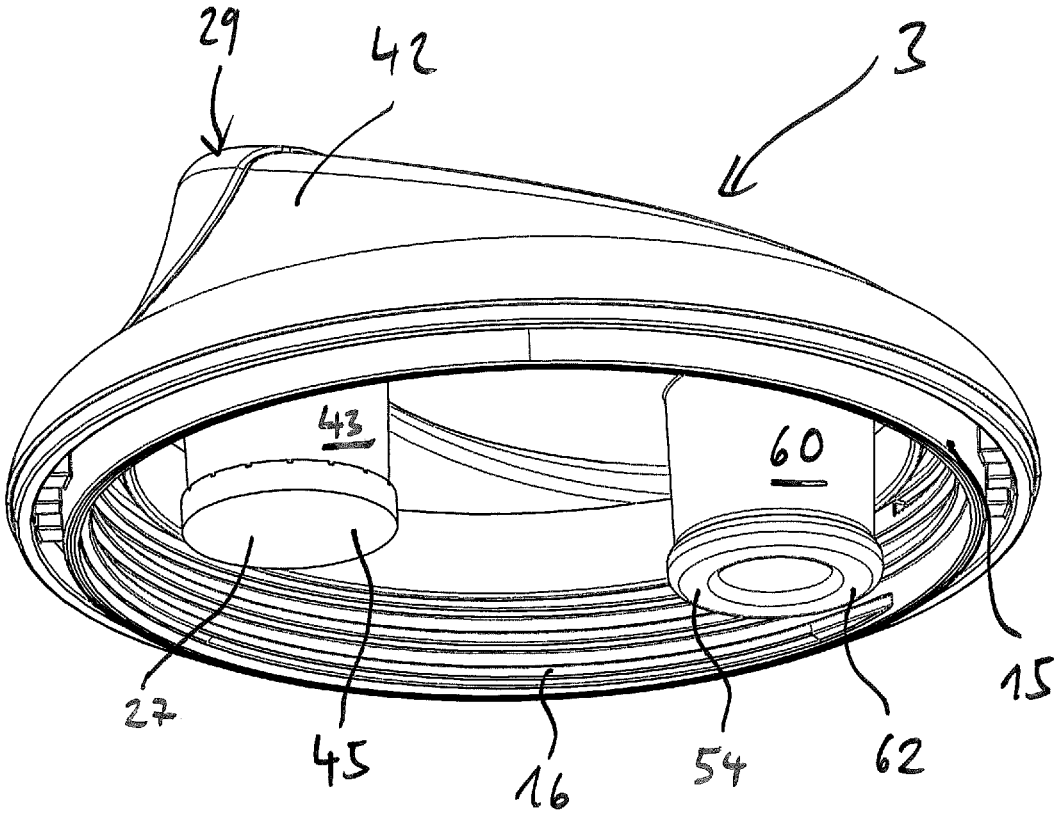
FIG. 20 shows the same drinking attachment comprising valve elements in a perspective view diagonally from below.
Figure 21:
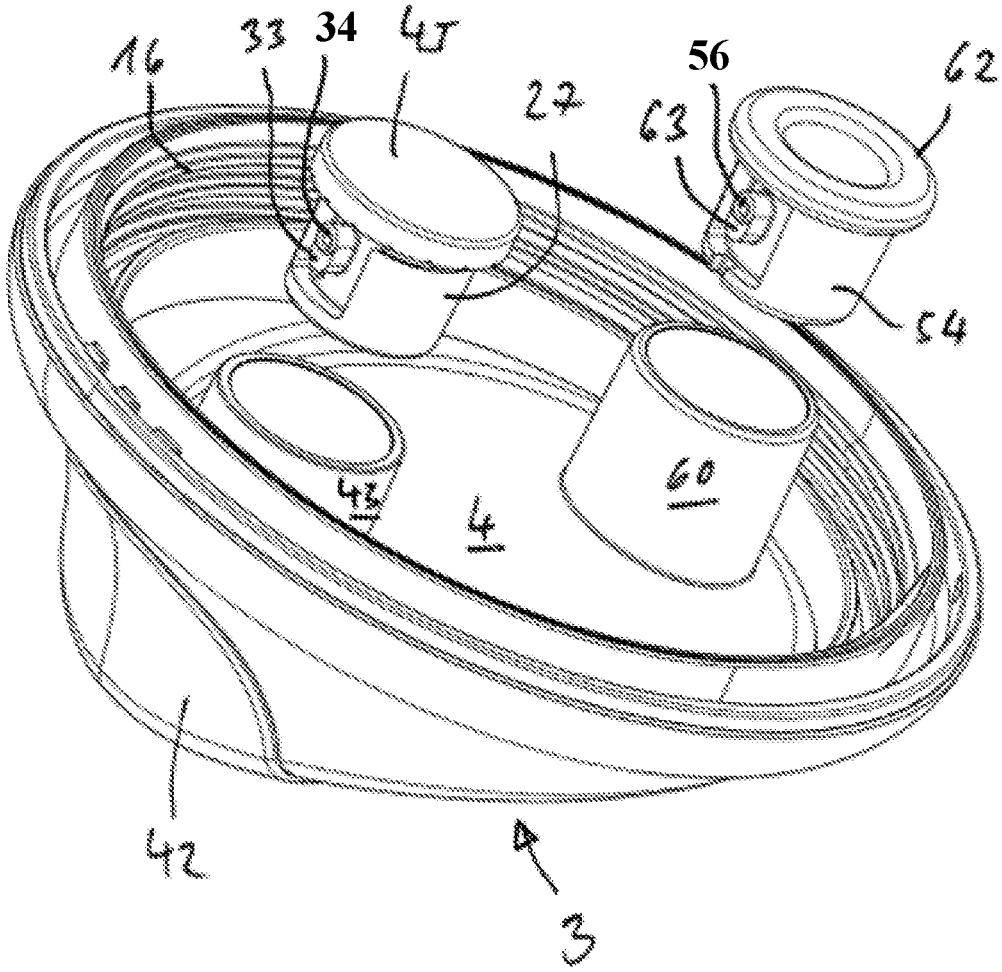
FIG. 21 shows the same drinking attachment comprising removed valve elements in a perspective view diagonally from below.

FIG. 19 shows a situation, in which a suction underpressure is present at the mouthpiece 42 and prevails in the interior 14. As a result, the diaphragm 32 is deflected and the flow-through opening 34 of the drinking valve is released, so that liquid can flow out through the mouthpiece 42. The third diaphragm 57 is deflected inwards through the internal pressure in the interior 14 and the second flow-through opening is released, so that air can continue to flow into the interior 14 through the venting hole 61, the second continued flow channel 59, the second flow-through opening 56, and the second tube 54, in order to effect a pressure compensation.

The invention claimed is:

1. A drinking vessel comprising:

a drinking container comprising an interior, a drinking attachment comprising a bottom wall and a straw, which protrudes upwards from the bottom wall and which has at least one drinking opening on the outer end, which is connected to the interior of the drinking container via a passage channel, which extends through the straw, holding devices for releasably holding the drinking attachment on the drinking container, a drinking valve coupled to the straw, which closes when ambient pressure is present at the drinking opening, and which opens when a suction underpressure is present at the drinking opening, a suction tube disposed about a portion of the straw and drinking valve and comprising a tube wall, wherein the drinking valve comprises a tube, which is open on the top and closed on the bottom and a side wall comprising at least one flow-through opening, which connects an inside of the tube to an outside of the tube, wherein the side wall of the tube, at least in the area of the flow-through opening, is formed as an elastic diaphragm, and when ambient pressure is present at the drinking opening, the tube wall of the suction tube abuts with an outer rim of the flow-through opening so as to form a seal and, when a suction underpressure is present at the drinking opening, the diaphragm bulges inwards, so that the outer rim of the flow-through opening moves away from the tube wall of the suction tube.

2. The drinking vessel according to claim 1, wherein the flow-through opening extends across the side wall of the tube of the drinking valve.

3. The drinking vessel according to claim 1, wherein the side wall of the drinking valve comprises a depression in an outside portion of the side wall and the diaphragm is a bottom of the depression.

4. The drinking vessel according to claim 1, wherein the outer rim of the flow-through opening, protrudes out from an outside of the diaphragm.

5. The drinking vessel according to claim 4, wherein the drinking valve further comprises a base member that protrudes out from the outside of the diaphragm, through which the flow-through opening extends, wherein the base abuts the tube wall of the suction tube so as to form a seal with the outer rim of the flow-through opening, when ambient pressure is present at the drinking opening, and lifts off the tube wall of the suction tube, when a suction underpressure is present at the drinking opening.

6. The drinking vessel according to claim 5, wherein the outer rim of the flow-through opening protrudes from an outside wall of the base member.

7. The drinking vessel according to claim 6, wherein the base member is an elongated element oriented in a longitudinal direction of the straw and comprises a rectangular cross section.

8. The drinking vessel according to claim 1, wherein the straw has at least one continuous flow channel, which extends from the diaphragm to a lower end of the straw.

9. The drinking vessel according to claim 1, wherein the straw is made of a unitary piece of elastic material.

10. The drinking vessel according to claim 1, wherein the straw is connected to the suction tube and protrudes into the drinking container from the underside of the bottom wall.

11. The drinking vessel according to claim 10, wherein the suction tube, drinking valve, and the straw are formed from one piece of material.

12. The drinking vessel according to claim 10, wherein the straw comprises a sealing edge, which protrudes outwards, at a distance from a lower end of the straw, and up to which the suction tube is pushed onto the straw.

13. The drinking vessel according to claim 10, wherein, the straw further comprises at least one circumferential sealing element on an outside wall of the straw that abuts the tube wall of the suction tube so as to form a seal between the straw and the suction tube.

14. The drinking vessel according to claim 1, wherein the straw comprises a circumferential flange extending out from an outside wall of the straw that forms a seal with the bottom wall of the drinking attachment.

15. The drinking vessel according to claim 14, wherein the flange abuts a sealing surface disposed along a bottom side of the bottom wall so as to form the seal between the drinking straw and the bottom wall.

16. The drinking vessel according to claim 15, wherein the flange is conical and abuts a conical sealing surface of the bottom wall so as to form the seal.

17. The drinking vessel according to claim 16, wherein the flange is soft elastic and the sealing surface of the bottom wall has a venting hole, which extends from the outside to the inside of the bottom wall, wherein the flange abuts the sealing surface so as to form a seal, when ambient pressure prevails in the interior, and the flange lifts off the sealing surface, when a suction underpressure is present in the interior.

18. The drinking vessel according to claim 1, wherein the straw and the drinking attachment are formed from one piece of material.

* * * * *